US007311069B2

(12) United States Patent
Kobayashi et al.

(10) Patent No.: US 7,311,069 B2
(45) Date of Patent: Dec. 25, 2007

(54) VARIABLE VALVE TIMING CONTROL DEVICE

(75) Inventors: Masaki Kobayashi, West Bloomfield, MI (US); Katsuhiko Eguchi, Kariya (JP); Kazumi Ogawa, Toyota (JP); Yoshiyuki Kawai, Nagoya (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 413 days.

(21) Appl. No.: 11/019,399

(22) Filed: Dec. 23, 2004

(65) Prior Publication Data

US 2005/0150473 A1 Jul. 14, 2005

Related U.S. Application Data

(63) Continuation-in-part of application No. 10/875,736, filed on Jun. 25, 2004, now abandoned.

(30) Foreign Application Priority Data

Jun. 25, 2003 (JP) ..... 2003-181475
Feb. 25, 2004 (JP) ..... 2004-049746

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18, 90.27, 90.31; 464/1, 464/2, 160
See application file for complete search history.

(56) References Cited

U.S. PATENT DOCUMENTS 5,901,674 A * 5/1999 Fujiwaki ..... 123/90.17
6,302,072 B1 * 10/2001 Sekiya et al. ..... 123/90.17
2001/0054405 A1 12/2001 Miyasaka

FOREIGN PATENT DOCUMENTS

EP 1 008 729 A2 6/2000

OTHER PUBLICATIONS

European Search Report dated Oct. 13, 2005.

* cited by examiner

*Primary Examiner*—Ching Chang
(74) *Attorney, Agent, or Firm*—Buchanan Ingersoll & Rooney PC

(57) ABSTRACT

A variable valve timing control device includes a housing member, a rotor member assembled to the housing member so as to be rotatable relative thereto and including vane portions each forming an advanced angle chamber and a retarded angle chamber within the housing member, a stopper formed on the convex portion for restricting a relative rotation between the housing member and the rotor member, a lock mechanism for restricting the relative rotation by a lock member, and a fluid pressure circuit for controlling an operation oil to be supplied to or discharged from the advanced angle chamber, the retarded angle chamber, and the lock mechanism. When the relative rotation is restricted, the lock member is in contact with an inner peripheral face of the receiving hole on the advanced angle side and the retarded angle side between an opening portion and a bottom portion of the receiving hole.

17 Claims, 5 Drawing Sheets

VARIABLE VALVE TIMING CONTROL DEVICE

This application is a continuation-in-part application of earlier filed U.S. application Ser. No. 10/875,736 filed on Jun. 25, 2004 now abandoned, and claims priority under U.S.C. § 120 with respect to such earlier filed application.

CROSS REFERENCE TO RELATED APPLICATIONS

This application is based on and claims priority under 35 U.S.C. § 119 to Japanese Patent Application 2003-181475, filed on Jun. 25, 2003 and No. 2004-049746, filed on Feb. 25, 2004, the entire content of which is incorporated herein by reference.

FIELD OF THE INVENTION

This invention generally relates to a variable valve timing control device. More particularly, the present invention pertains to a variable valve timing control device for controlling an opening and closing timing of an intake valve and exhaust valve of an internal combustion engine.

BACKGROUND

Known variable valve timing control devices are disclosed in Japanese Patent Nos. 3266013 and 3146956. The disclosed variable valve timing control devices each include a housing member integrally rotating with one of a crankshaft and a camshaft of an internal combustion engine, a rotor member assembled to the housing member so as to be rotatable relative thereto and being slidable on a concave portion formed on the housing member. The rotor member includes vane portions each forming an advanced angle chamber and a retarded angle chamber within the housing member, and integrally rotating with the other one of the crankshaft and the camshaft. The variable valve timing control device also includes a stopper formed on the convex portion and being in contact with at least one of the vane portions for restricting the relative rotation between the housing member and the rotor member to an advanced angle side or a retarded angle side. The variable valve timing control device further includes a lock mechanism for restricting the relative rotation between the housing member and the rotor member by a lock member formed on the housing member to be inserted into a receiving hole formed on the rotor member when a relative rotation phase between the housing member and the rotor member is positioned at a predetermined phase, and a fluid pressure circuit for controlling an operation oil to be supplied to or discharged from the advanced angle chamber, the retarded angle chamber, and the lock mechanism.

According to the variable valve timing control device disclosed in Japanese Patent No. 3266013, when the lock member is in contact with an opening edge portion of a receiving hole within which the lock member is positioned, plastic flow of material forming the receiving hole may be caused due to tangential stress. Then, the opening edge portion may be raised towards the housing member side. Further, the opening edge portion being raised may interfere with the relative rotation between the housing member and the rotor member. In order to address the above problem, the lock member includes an engaging taper face on a side of the receiving hole while the receiving hole includes a guiding taper face gradually expanding towards an opening side of the receiving hole. The lock member is in contact with an inner peripheral face of the receiving hole under the condition that a taper angle of the guiding taper face is larger than that of the engaging taper face. Then, the plastic flow may be prevented from occurring in the opening edge portion of the receiving hole.

In addition, according to the variable valve timing control device disclosed in Japanese Patent No. 3146956, a clearance is formed between the lock member and the receiving hole considering a receiving performance of the lock member in the receiving hole. When the advanced angle chamber or the retarded angle chamber is not sufficiently supplied with the operation fluid from an oil pump at a time of an engine start, the rotor member and the housing member starts rotating relative to each other due to the fluctuation torque of the cam being applied. At this time, since the clearance is formed between the lock member and the receiving hole, an inner periphery of the receiving hole and an outer periphery of the lock member may become in contact with each other repeatedly, thereby causing a hitting sound. In order to address the above problem; a taper face is formed on at least one of the lock member and the receiving hole being in contact with each other. Then, a biasing force to bias the rotor member in the rotational direction is generated in the housing member to strongly press the stopper and the vane portion to each other so that the rotor member and the housing member are constrained at a locked position.

According to the variable valve timing control device disclosed in Japanese Patent No. 3266013, the lock member can be in contact with the inner circumferential face of the receiving face. However, a clearance may be formed between the lock member and the receiving hole, which causes a looseness therebetween. Further, the hitting sound due to the looseness may occur.

In addition, according to the variable valve timing control device disclosed in Japanese Patent No. 3146956, the rotor member and the housing member are constrained at the locked position and thus the lock member may not be able to move from the receiving hole.

Thus, a need exists for a variable valve timing control device which can prevent an occurrence of hitting sound due to a relative rotation between a lock member and a receiving hole in case of the relative rotation being locked.

A need also exists for a variable valve timing control system in which the lock member is prevented from being constrained in the receiving hole when the locked state of the relative rotation is released.

SUMMARY OF THE INVENTION

According to an aspect of the present invention, a variable valve timing control device includes a housing member integrally rotating with one of a crankshaft and a camshaft of an internal combustion engine, and a rotor member assembled to the housing member so as to be rotatable relative thereto and being slidable on a convex portion formed on the housing member, the rotor member including vane portions each forming an advanced angle chamber and a retarded angle chamber within the housing member, the rotor member integrally rotating with the other one of the crankshaft and the camshaft. The variable valve timing control device also includes a stopper formed on the convex portion and being in contact with at least one of the vane portions for restricting a relative rotation between the housing member and the rotor member to an advanced angle side or a retarded angle side, a lock mechanism for restricting the relative rotation between the housing member and the rotor member by a lock member formed on the housing member to be inserted into a receiving hole formed on the rotor member when a relative rotation phase between the housing member and the rotor member is positioned at a predetermined phase, and a fluid pressure circuit for controlling an operation oil to be supplied to or discharged from the advanced angle chamber, the retarded angle chamber, and the lock mechanism. When the relative rotation between the housing member and the rotor member is restricted, the lock member is in contact with an inner peripheral face of the receiving hole on the advanced angle side and the retarded angle side between an opening portion and a bottom portion of the receiving hole.

According to another aspect of the prevent invention, a variable valve timing control device includes a housing member integrally rotating with one of a crankshaft and a camshaft of an internal combustion engine, and a rotor member assembled to the housing member so as to be rotatable relative thereto and being slidable on a convex portion formed on the housing member, the rotor member including vane portions each forming an advanced angle chamber and a retarded angle chamber within the housing member, the rotor member integrally rotating with the other one of the crankshaft and the camshaft. The variable valve timing control device also includes a stopper formed on the convex portion and being in contact with at least one of the vane portions for restricting a relative rotation between the housing member and the rotor member to an advanced angle side or a retarded angle side, a lock mechanism for restricting the relative rotation between the housing member and the rotor member by a lock member formed on the housing member to be inserted into a receiving hole formed on the rotor member when a relative rotation phase between the housing member and the rotor member is positioned at a predetermined phase, and a fluid pressure circuit for controlling an operation oil to be supplied to or discharged from the advanced angle chamber, the retarded angle chamber, and the lock mechanism. When the relative rotation between the housing member and the rotor member is restricted, a contact width in a circumferential direction of a contact portion of the lock member, with which an inner peripheral face of the receiving hole on the advanced angle side and the retarded angle side is in contact, is larger than a bottom width in the circumferential direction of a bottom portion of the receiving hole.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Figure 1:
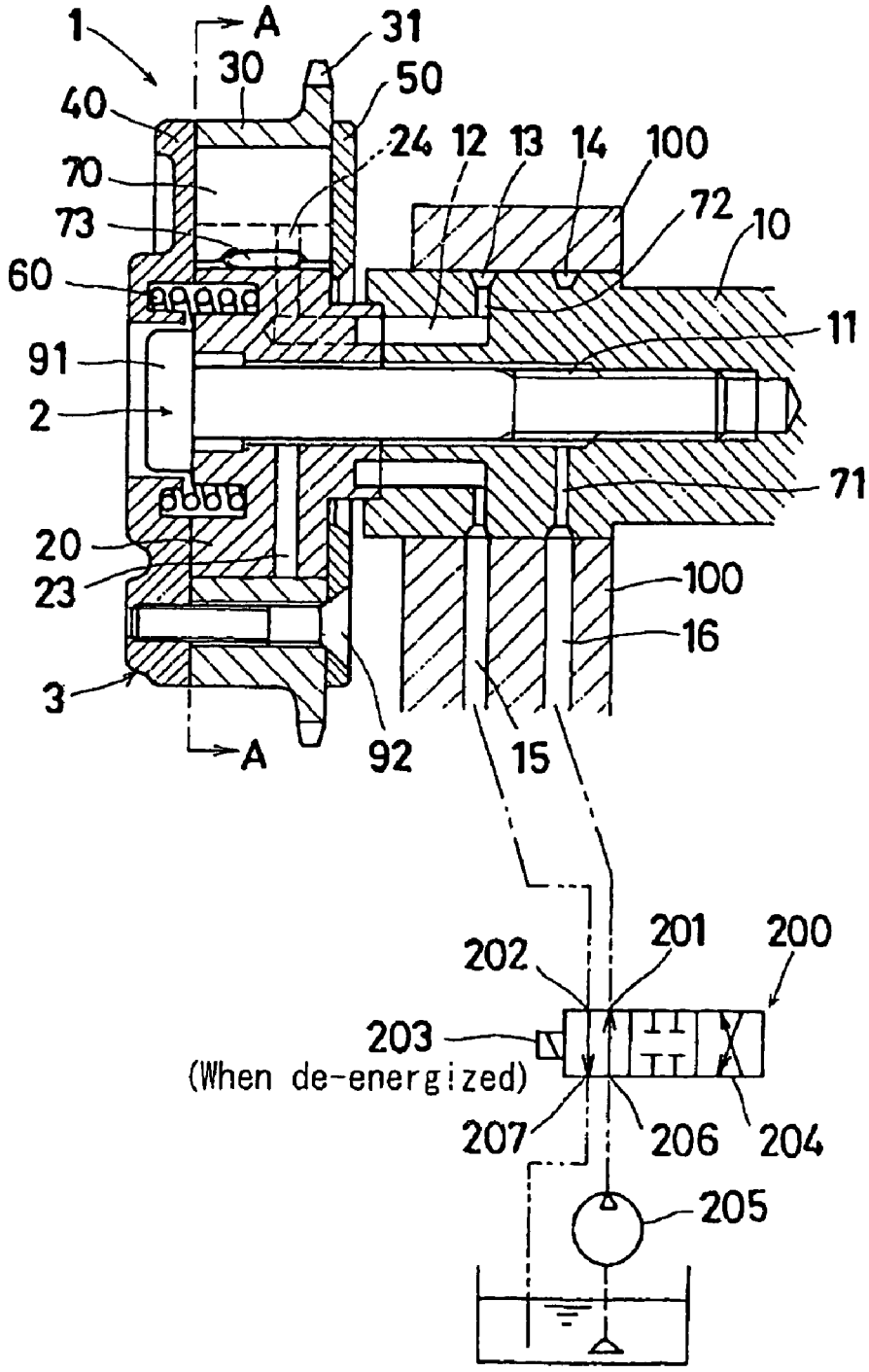
FIG. 1 is a longitudinal sectional view of a variable valve timing control device according to an embodiment of the present invention.

A first embodiment of the present invention is explained referring to attached drawings. A variable valve timing control device 1 shown in FIGS. 1 to 3 includes a rotor member 2 for opening/closing a valve, which includes a camshaft 10 rotatably supported on a cylinder head 100 of an internal combustion engine and an inner rotor 20 integrally fixed to a tip end portion of the camshaft 10. The variable valve timing control device 1 also includes a housing member 3 having an outer rotor 30 being rotatable relative to the inner rotor 20 within a predetermined range, a front plate 40, and a rear plate 50. A timing sprocket 31 is integrally formed on an outer periphery of the outer rotor 30. Further, the variable valve timing control device 1 includes a torsion spring 60 disposed between the inner rotor 20 and the front plate 40, four vanes 70 assembled to the inner rotor 20, and a lock plate 80 (lock member) (see FIG. 2) assembled to the outer rotor 30.

Figure 2:
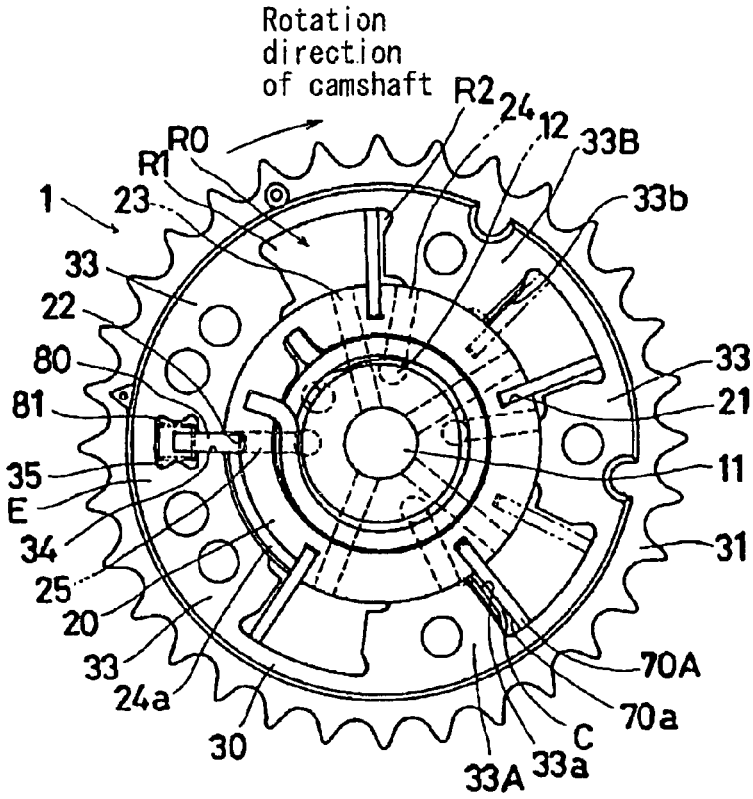
FIG. 2 is a cross-sectional view taken along the ling A-A of FIG. 1.

The timing sprocket 31 receives the rotation force in the clockwise direction thereof, which is shown as a rotation direction of camshaft in FIG. 2. The rotation force is transmitted from a crankshaft (not shown) via a crank sprocket (not shown) and a timing chain (not shown).

The camshaft 10 includes a known cam (not shown) for opening/closing an exhaust valve (not shown). An advanced angle fluid passage (fluid pressure circuit) 11 and a retarded angle fluid passage (fluid pressure circuit) 12 extending in an axial direction of the camshaft 10 are provided inside of the camshaft 10. The advanced angle fluid passage 11 is connected to a first connecting port 201 of a switching valve 200 via a passage 71 provided on the camshaft 10 in the radial direction thereof, an annular groove 14, and a connecting passage 16 provided on the cylinder head 100. In addition, the retarded angle fluid passage 12 is connected to a second connecting port 202 of the switching valve 200 via a passage 72 provided on the camshaft 10 in the radial direction thereof, an annular groove 13, and a connecting passage 15 provided on the cylinder head 100.

The switching valve 200 is a known type in which a spool 204 is moved against a biasing force of a spring (not shown) by energizing a solenoid 203. When the solenoid 203 is de-energized, a supply port 206 connected to an oil pump 205 that is driven by the internal combustion engine communicates with the first connecting port 201 as shown in FIG. 1. At the same time, the second connecting port 202 communicates with a discharge port 207. When the solenoid 203 is energized, the supply port 206 communicates with the second connecting port 202 and at the same time the first connecting port 201 communicates with the discharge port 207. Therefore, in case that the solenoid 203 of the switching valve 200 is de-energized, the operation fluid (fluid pressure) is supplied to the advanced angle fluid passage 11. In case that the solenoid 203 is energized, the operation fluid is supplied to the retarded angle fluid passage 12. Energization of the solenoid 203 of the switching valve 200 is duty-controlled by which a ratio of energization/de-energization per unit time is changed. For example, when the switching valve 200 is duty-controlled at 50%, the first and second ports 201 and 202, and the supply and discharge ports 206 and 207 are not connected to each other.

The inner rotor 20 is integrally fixed to the camshaft 10 via an installation bolt 91. As shown in FIG. 2, four vane grooves 21 and a receiving hole 22 are formed on the inner rotor 20. In addition, four first fluid passages 23 (fluid pressure circuit), three second fluid passages 24 (fluid pressure circuit) extending in the radial direction of the inner rotor 20, a fluid groove 24*a* (fluid pressure circuit), and a lock fluid passage 25 for connecting a bottom portion 22*d* of the receiving hole 22 to the advanced angle fluid passage 11.

As shown in FIG. 2, the vanes 70 are positioned in the vane grooves 21 respectively, being movable in the radial direction of the inner rotor 20. The four vanes 70 are movable within four fluid pressure chambers R0 respectively, which are each defined between the outer rotor 30 and the inner rotor 20 and arranged, dividing each fluid pressure chamber R0 into an advanced angle chamber R1 and a retarded angle chamber R2. Each vane 70 is biased in the radially outward direction by a vane spring 73 (see FIG. 1) disposed between the bottom portion of each vane groove 21 and the bottom face of each vane 70.

As shown in FIG. 2, the operation fluid (fluid pressure) is supplied to or discharged from the four advanced angle chambers R1, which are defined and divided by the vanes 70, via the advanced angle fluid passage 11 and the first fluid passage 23. In addition, the operation fluid is supplied to or discharged from three retarded angle chambers R2 out of four via the retarded angle fluid passage 12 and the second fluid passage 24. The operation fluid is supplied to the lock plate 80 from the lock fluid passage 25 formed on the bottom portion 22*d* of the receiving hole 22. When the lock plate 80 is moved, the operation fluid is supplied to or discharged from the remaining (i.e. one out of four) retarded angle chamber R2 via the fluid groove 24*a* connecting the lock fluid passage 25 and that retarded angle chamber R2. Accordingly, for one retarded angle chamber R2 out of four, the second fluid passage 24 is not provided and the lock fluid passage 25 is shared to be used, which may achieve a simple structure of the fluid pressure circuit.

Both side portions of the outer rotor 30 in the axial direction thereof are integrally fixed to the annular shaped front plate 40 and the rear plate 50 respectively via five connecting bolts 92. The timing sprocket 31 is integrally formed on an outer periphery of the outer rotor 30 and on an end side in the axial direction thereof to which the rear plate 50 is connected. In addition, five convex portions 33 are formed on the inner circumference of the outer rotor 30 in the circumferential direction thereof so as to project in the radially inward direction. Each inner circumferential face of each convex portion 33 is slidably in contact with an outer circumferential face of the inner rotor 20. That is, the outer rotor 30 is rotatably supported on the inner rotor 20. A side face 33*a* (stopper) of one convex portion 33A out of the five convex portions 33 is in contact with a side face 70*a* of a vane 70A, thereby restricting a relative rotational angle between the outer rotor 30 and the inner rotor 20 to the advanced angle side. In addition, a side face 33*b* (stopper) of one convex portion 33B is in contact with a side face 70*b* of a vane 70B, thereby restricting the relative rotational angle between the outer rotor 30 and the inner rotor 20 to the retarded angle side. A retracting groove portion 34 for accommodating the lock plate 80, and a receiving bore 35 connected to the retracting groove portion 34 for accommodating a coil spring 81 that biases the lock plate 80 in the radially inward direction of the outer rotor 30 are formed between the two convex portions 33 out of five. The four fluid pressure chambers R0 mentioned above are formed between five convex portions 33, respectively.

Figure 3:
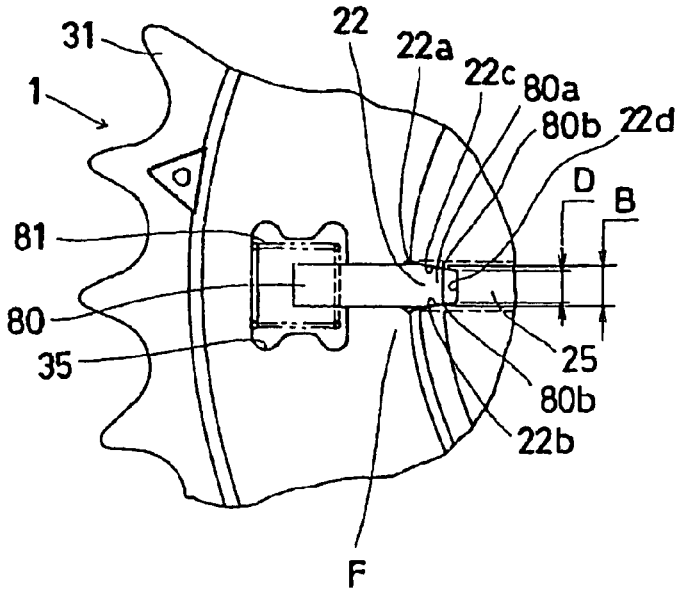
FIG. 3 is an enlarged view of E portion of FIG. 2.
Figure 4:
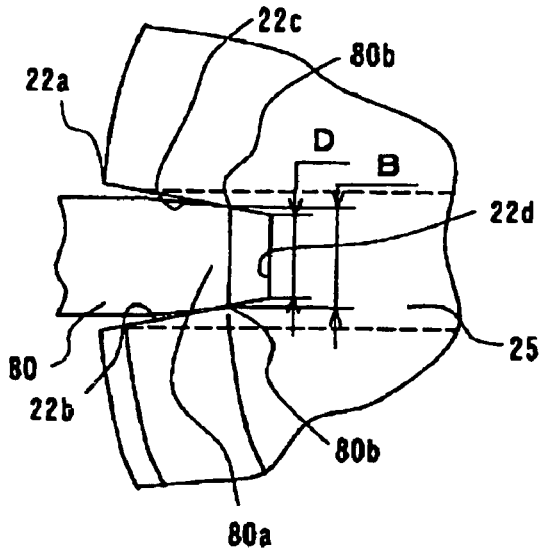
FIG. 4 is an enlarged view of F portion of FIG. 3.

As shown in FIG. 3, a head portion 80*a* of the lock plate 80, i.e. facing the bottom portion 22*d* of the receiving hole 22, has a trapezoidal shape in cross section formed by a convex taper portion extending in the radially inward direction of the outer rotor 30 and a top portion. An inner peripheral face 22*b* is formed by a concave taper portion 22*c* having a trapezoidal shape in cross section and gradually expanding towards an opening portion 22*a*, and the bottom portion 22*d*. When the relative rotation between the inner rotor 20 and the outer rotor 30 is restricted, the lock plate 80 is positioned in the receiving hole 22. An end portion 80*b* (contact portion) of the top portion of the lock plate 80 is in contact with the inner peripheral face 22*b* of the receiving hole 22 on the advanced angle side and the retarded angle side between the opening portion 22*a* and the bottom portion 22*d* of the receiving hole 22. In addition, a contact width B in the circumferential direction of the contact portion 80*b* of the lock plate 80, with which the inner peripheral face 22*b* of the receiving hole 22 on the advanced angle side and the retarded angle side is in contact, is larger than a bottom width D in the circumferential direction of the bottom portion 22*d* of the receiving hole 22. Therefore, when the lock plate 80 is positioned in the receiving hole 22, the end portion 80*b* of the lock plate 80 and the taper portion 22*c* of the inner peripheral face 22*b* of the receiving hole 22 are in contact with each other on the advanced angle side and the retarded angle side, thereby restricting the relative rotation between the inner rotor 20 and the outer rotor 30. As a result, the occurrence of the hitting sound by the contact between the end portion 80*b* and the taper portion 22*c* due to the fluctuation torque of the cam may be prevented. The head portion 80*a* of the lock plate 80 may have a substantially rectangular shape instead of the trapezoidal shape. The end portion 80*b* of the lock plate 80 may be chamfered.

When the relative rotation between the inner rotor 20 and the outer rotor 30 is restricted, the lock plate 80 is positioned in the receiving hole 22. At the same time, a gap C is formed between the side face 33*a* of the convex portion 33A and the side face 70*a* of the vane 70A. Therefore, when the fluctuation torque by the camshaft 10 is applied to the end portion 80*b* and the taper portion 22*c* in the advanced angle direction and the retarded angle direction alternately under the condition that the operation fluid is supplied to the receiving hole 22 and thus the relative rotation between the inner rotor 20 and the outer rotor 30 is permitted, i.e. the locked state thereof is released, the lock plate 80 and the receiving hole 22 are prevented from being strongly constrained each other. Then, the lock plate 80 and the receiving hole 22 rotate relative to each other, which brings the end portion 80*b* of the lock plate 80 to be pushed by the taper portion 22*c* of the inner peripheral face 22*b* of the receiving hole 22. The lock plate 80 is thus biased to move from the receiving hole 22, thereby causing the locked state of the relative rotation between the inner rotor 20 and the outer rotor 30 to be easily released.

A size of the gap C is defined such that when the side face 70*a* of the vane 70A is in contact with the side face 33*a* of the convex portion 33A to thereby restrict the relative rotation between the inner rotor 20 and the outer rotor 30 at the most advanced angle phase, the head portion 80*a* of the lock plate 80 is guided in radially inward direction of the receiving hole 22 with being in contact with the inner peripheral face 22*b* of the receiving hole 22. That is, when the relative rotation between the inner rotor 20 and the outer rotor 30 is restricted at the most advanced angle phase by the side face 70*a* of the vane 70A being in contact with the side face 33*a* of the convex portion 33A, the head portion 80*a* of the lock plate 80 is guided in the radially inward direction of the receiving hole 22. Then, when the vane 70 is separated from the convex portion 33 due to the fluctuation torque of the cam, the head portion 80*a* of the lock plate 80 is further inserted into the radially inward direction of the receiving hole 22. The end portion 80*b* of the lock plate 80 and the taper portion 22*c* of the inner peripheral face 22*b* of the receiving hole 22 are in contact with each other on the advanced angle side and the retarded angle side, thereby restricting the relative rotation between the inner rotor 20 and the outer rotor 30.

The torsion spring 60 is provided by engaging with the front plate 40 at one end and the inner rotor 20 at the other end. The torsion spring 60 biases the inner rotor 20 towards the advanced angle side (clockwise direction in FIG. 2) relative to the outer rotor 30, the front plate 40 and the rear plate 50. Thus, the operation response of the inner rotor 20 to the advanced angle side may be improved.

According to the above-mentioned embodiment, when the internal combustion engine is stopped, the oil pump 205 is stopped and also the switching valve 200 is not energized. Thus, the operation fluid is not supplied to the fluid pressure chambers R0. At this time, the head portion 80*a* of the lock plate 80 is positioned within the receiving hole 22 of the inner rotor 20 and thus the relative rotation between the inner rotor 20 and the outer rotor 30 is restricted. Even when the internal combustion engine is started and the oil pump 205 is driven, the operation fluid supplied from the oil pump 205 is only virtually provided to the advanced angle chamber R1 via the connecting passage 16, the advanced angle fluid passage 11, and the first fluid passage 23 while the duty ratio is small for energizing the switching valve 200 (i.e. the ratio of energizing time relative to the de-energizing time per unit time is small). Therefore, the variable valve timing control device 1 is maintained in a locked state.

When the retarded angle phase is required for the valve timing depending on the operation condition of the internal combustion engine, the duty ratio for energizing the switching valve 200 is brought to be large and then the position of the spool 204 is switched. The operation fluid supplied from the oil pump 205 is provided to the retarded angle chamber R2 by passing through the connecting passage 15, the retarded angle fluid passage 12, and the second fluid passage 24, or by passing through the fluid groove 24*a* after supplied to the receiving hole 22 from the lock fluid passage 25.

Meanwhile, the operation fluid stored in the advanced angle chamber R1 is sent to the first fluid passage 23, the advanced angle fluid passage 11, and the connecting passage 16 to be discharged from the discharge port 207 of the switching valve 200. Therefore, the lock plate 80 is moved against the biasing force of the spring 81, thereby moving the head portion 80*a* from the receiving hole 22. Then, the locked state between the inner rotor 20 and the outer rotor 30 is released. At the same time, the inner rotor 20 integrally rotating with the camshaft 10 and each vane 70 rotate relative to the outer rotor 30, the front plate 40, and the rear plate 50 in the retarded angle direction (counterclockwise direction in FIG. 2). Due to the aforementioned relative rotation, the timing of the cam is brought in the advanced angle state. The relative rotation phase may be defined arbitrarily by controlling the duty ratio of the switching valve 200. For example, the relative rotation between the inner rotor 20 and the outer rotor 30 may be stopped at the intermediate phase.

Figure 5:
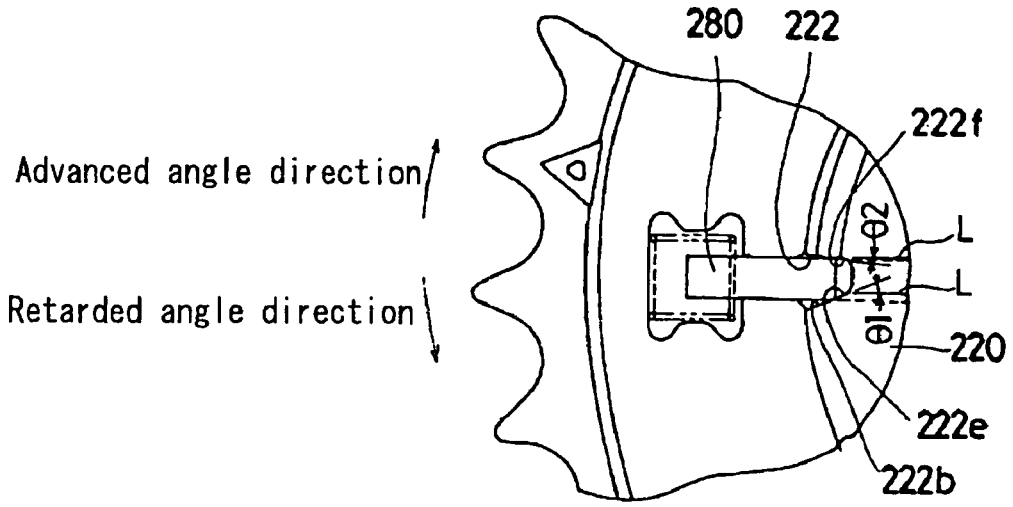
FIG. 5 is an enlarged view of F portion of FIG. 3 according to a second embodiment of the present invention.

Next, a second embodiment of the present invention is explained referring to FIG. 5.

As shown in FIG. 5, an advanced angle side face 222*e* provided in the retarded angle direction on an inner face 222*b* of a receiving hole 222 and a retarded angle side face 222*f* provided in the advanced angle direction on the inner face 222*b* of the receiving hole 222 form predetermined tapered angles θ1 and θ2 respectively relative to each line L in parallel with a radial direction of an inner rotor 220 in addition to a structure of the first embodiment. The tapered angle θ1 is larger than the tapered angle θ2. The rest of the structure of the second embodiment is same as the first embodiment and thus the explanation thereof is omitted.

According to the second embodiment, the tapered angle θ1 is larger than the tapered angle θ2, i.e. θ1>θ2. Thus, when the relative rotation between the inner rotor 220 and the outer rotor 30 is in the locked state, a force for causing a lock plate 280 to move from the inner face 222*b* of the receiving hole 222 by the cam torque fluctuation applied to the inner rotor 220 via the camshaft 10 in case of the tapered angle θ1 being larger than θ2 is smaller than that in case of the tapered angle θ1 being equal to the tapered angle θ2 (i.e. θ1=θ2). The locked state of the relative rotation between the inner rotor 220 and the outer rotor 30 is prevented from released accordingly. At this time, alternatively, the tapered angle θ1 may be smaller than θ2, i.e. θ1<θ2.

According to the present embodiment, the variable valve timing control device is assembled to the camshaft (not shown) for opening and closing an intake valve (not shown).

Figure 6:
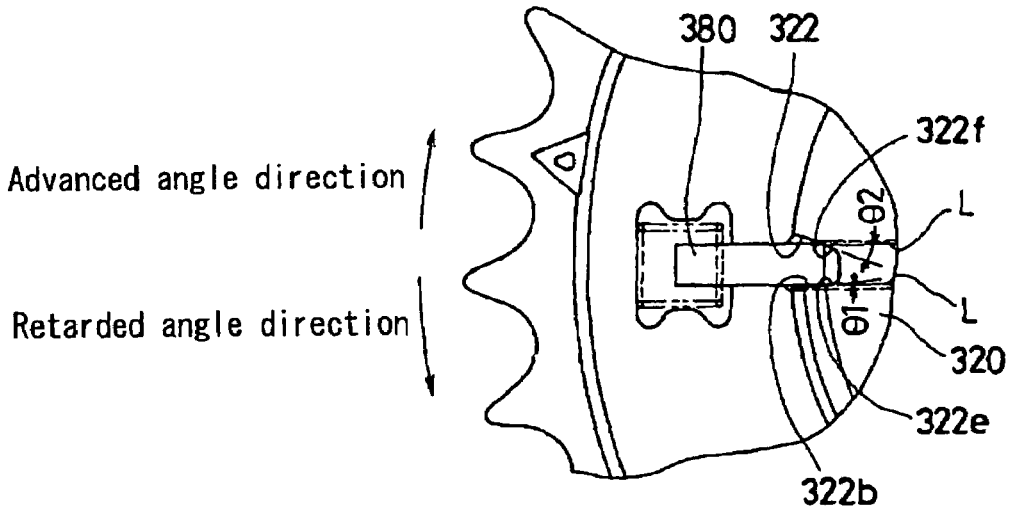
FIG. 6 is an enlarged view of F portion of FIG. 3 according to a third embodiment of the present invention.
Figure 7:
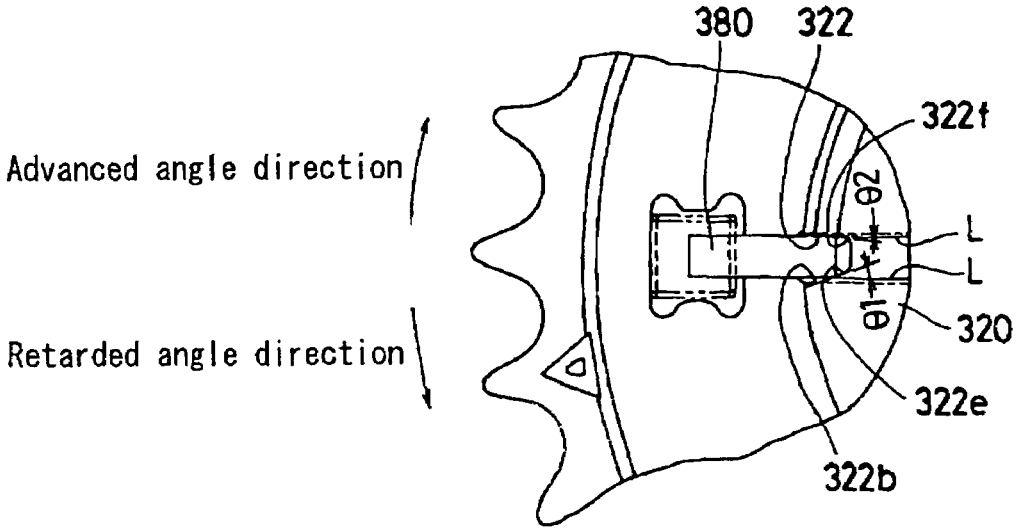
FIG. 7 is an enlarged view of F portion of FIG. 3 according to the third embodiment of the present invention.

A third embodiment of the present invention is explained referring to FIGS. 6 and 7.

As shown in FIG. 6, the tapered angle θ2 of a retarded angle side face 322*f* provided in the opposite direction to the retarded angle direction in which the relative rotation is permitted by the release of the lock mechanism composed by a lock plate 380 and a receiving hole 322 is larger than the tapered angle θ1 of an advanced angle side face 322*e*. The rest of the structure of the third embodiment is same as the second embodiment and thus the explanation thereof is omitted.

The tapered angle θ2 of the retarded angle side face 322*f* provided in the opposite direction to the retarded angle direction in which the relative rotation is permitted by the release of the lock mechanism composed by the lock plate 380 and the receiving hole 322 is larger than the tapered angle θ1 of the advanced angle side face 322*e*. Therefore, when the relative rotation between an inner rotor 320 and the outer rotor 30 is permitted, a force for causing the lock plate 380 to move from an inner peripheral face 322*b* of the receiving hole 322 is generated by a phase conversion torque added to the inner rotor 320 via the camshaft 10 in the retarded angle direction in which the relative rotation permitted. Then, the performance of the lock plate 380 to move from the receiving hole 322 is increased along with the operation fluid (fluid pressure) being supplied. In the variable valve timing control device assembled to the camshaft for opening and closing the intake valve (not shown), the tapered angle θ1 of the advanced angle side face 322*e* provided in the opposite direction to the advanced angle direction in which the relative rotation is permitted by the release of the lock mechanism composed by the lock plate 380 and the receiving hole 322 is larger than the tapered angle θ2 of the retarded angle side face 322*f*.

Figure 8:
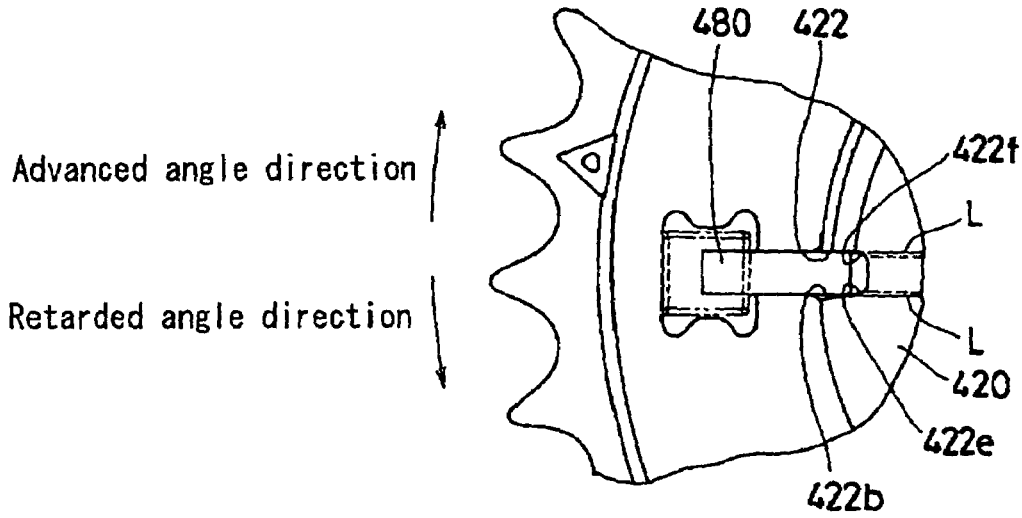
FIG. 8 is an enlarged view of F portion of FIG. 3 according to a fourth embodiment of the present invention.

A fourth embodiment of the present invention is explained referring to FIG. 8.

As shown in FIG. 8, a retarded angle side face 422*f* provided in the advanced angle direction on a receiving hole 422 is in contact with a side face of a lock plate 480 facing to the retarded angle side face 422*f* when the relative rotation between an inner rotor 420 and the outer rotor 30 is restricted and thus the lock plate 480 is positioned within the receiving hole 422. The rest of the structure of the fourth embodiment is same as the second embodiment and thus the explanation thereof is omitted. In addition, both side faces of the lock plate 480 in the retarded angle direction and the advanced angle direction thereof are formed, being in parallel with each line L in parallel with the radial direction of the inner rotor 420.

According to the fourth embodiment, a contact face pressure generated between the lock plate 480 and the receiving hole 422 is decreased by the side face in the advanced angle direction on the lock plate 480 being in contact with the retarded angle side face 422*f* of the receiving hole 422. Thus, an abnormal abrasion of the lock plate 480 and the receiving hole 422 may be decreased. According to the present embodiment, the variable valve timing control device is assembled to the camshaft (not shown) for opening and closing the intake valve (not shown).

Figure 9:
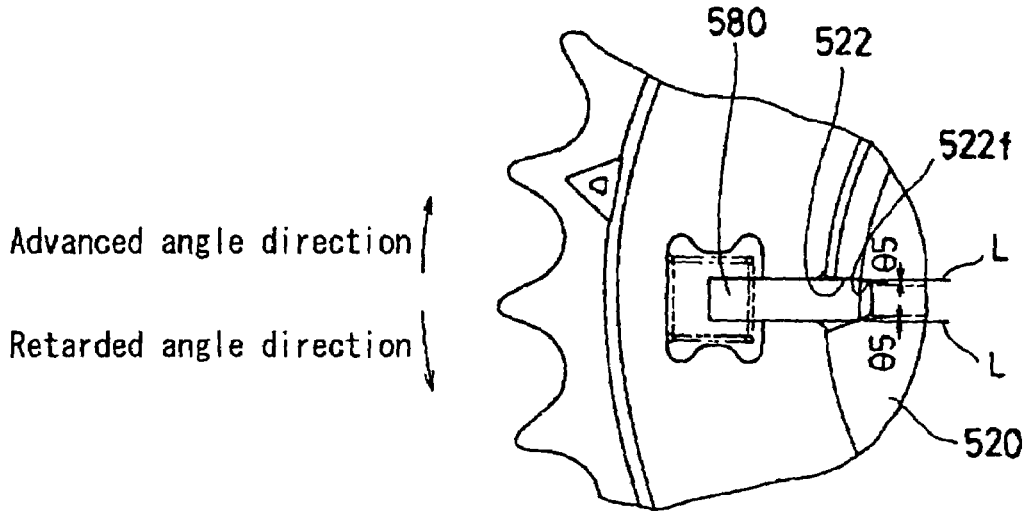
FIG. 9 is an enlarged view of F portion of FIG. 3 according to a fifth embodiment of the present invention.

A fifth embodiment of the present invention is explained referring to FIG. 9.

As shown in FIG. 9, a retarded angle side face 522*f* provided in the advanced angle direction on a receiving hole 522 is in contact with a side face of a lock plate 580 facing to the retarded angle side face 522*f* when the relative rotation between an inner rotor 520 and the outer rotor 30 is restricted and thus the lock plate 580 is positioned within the receiving hole 522. The rest of the structure of the fifth embodiment is same as the second embodiment and thus the explanation thereof is omitted. In addition, both side faces of the lock plate 580 in the retarded angle direction and the advanced angle direction thereof are inclined, each forming a predetermined angle θ5 with each line L in parallel with the radial direction of the inner rotor 520.

According to the fifth embodiment, a contact face pressure generated between the lock plate 580 and the receiving hole 522 may be reduced by the side face of the lock plate 580 in the advanced angle direction being in contact with the retarded angle side face 522*f* of the receiving hole 522. Therefore, the abnormal abrasion of the lock plate 580 and the receiving hole 522 may be reduced.

According to the aforementioned first embodiment, the lock plate 80 is in contact with the inner peripheral face 22*b* of the receiving hole 22 on the advanced angle side and the retarded angle side between the opening portion 22*a* and the bottom portion 22*d* of the receiving hole 22 when the relative rotation between the rotor member 2 and the housing member 3 is restricted. Thus, the lock plate 80 and the receiving hole 22 are in contact with each other to thereby restrict the relative rotation between the rotor member 2 and the housing member 3 to the advanced angle side and the retarded angle side. The occurrence of the hitting sound due to the contact between the lock plate 80 and the receiving hole 22 may be prevented accordingly.

In addition, according to the aforementioned first embodiment, when the relative rotation is restricted, the lock plate 80 and the receiving hole 22 are in contact with each other since the contact width B in the circumferential direction of the contact portion 80*b* of the lock plate 80, with which the inner peripheral face 22*b* of the receiving hole 22 on the advanced angle side and the retarded angle side is in contact, is larger than the bottom width D in the circumferential direction of the bottom portion 22*d* of the receiving hole 22, thereby avoiding the occurrence of the hitting sound.

Further, according to the aforementioned first embodiment, when the relative rotation is restricted, the lock plate 80 and the receiving hole 22 are prevented from being strongly constrained each other under the condition that the fluctuation torque by the camshaft 10 is applied to the contact portion 80*b* and the inner peripheral face 22*b* in the advanced angle direction and the retarded angle direction alternately since the gap C is formed between the side face 33*a* of the convex portion 33A and the side face 70*a* of the vane 70A. Thus, the lock plate 80 is moved from the receiving hole 22 by the operation fluid that is produced when the locked state of the relative rotation is released.

Furthermore, according to the aforementioned second embodiment, one of the tapered angles θ1 and θ2 is larger than the other one of the tapered angles θ1 and θ2. Thus, when the relative rotation between the inner rotor 220 and the outer rotor 30 is restricted, the force for causing the lock plate 280 to move from the inner peripheral face 222*b* of the receiving hole 222 by the cam torque fluctuation applied to the inner rotor 220 via the camshaft 10 in case of the tapered angle θ1 being larger than θ2 is smaller than that in case of the tapered angle θ1 being equal to the tapered angle θ2. The locked state of the relative rotation is prevented from being easily released accordingly.

Furthermore, according to the third embodiment, one of the tapered angles θ1 and θ2 of the advanced angle side face or the retarded angle side face provided in the opposite direction to a direction in which the relative rotation is permitted by the release of the lock mechanism obtained by the lock plate 380 and the receiving hole 322 is larger than the other one of the tapered angles θ1 and θ2. Thus, the force for causing the lock plate 380 to move from the inner peripheral face 322*b* of the receiving hole 322 is generated by a relative rotation torque obtained when the relative rotation between the inner rotor 320 and the outer rotor 30 is permitted. The lock plate 380 may surely move from the receiving hole 322.

Furthermore, according to the fourth embodiment, one of the advanced angle side face and the retarded angle side face of the receiving hole 422 is in contact with the facing side face of the lock plate 480. Thus, the contact face pressure generated between the lock plate 480 and the receiving hole 422 may be decreased, thereby decreasing the abnormal abrasion of the lock plate 480 and the receiving hole 422.

Furthermore, according to the fifth embodiment, one of the advanced angle side face and the retarded angle side face provided in a direction in which the relative rotation is permitted by the release of the lock mechanism obtained by the lock plate 580 and the receiving hole 522 is in contact with the facing side face of the lock plate 580. Thus, the contact face pressure generated between the lock plate 580 and the receiving hole 522 is decreased, thereby reducing the abnormal abrasion of the lock plate 580 and the receiving hole 522.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the sprit of the present invention. Accordingly, it is expressly intended that all such variations, changes and equivalents which fall within the spirit and scope of the present invention as defined in the claims, be embraced thereby.

The invention claimed is:

1. A variable valve timing control device comprising:

a housing member integrally rotating with one of a crankshaft and a camshaft of an internal combustion engine;

a rotor member assembled to the housing member so as to be rotatable relative thereto and being slidable on a convex portion formed on the housing member, the rotor member including vane portions each forming an advanced angle chamber and a retarded angle chamber within the housing member, the rotor member integrally rotating with the other one of the crankshaft and the camshaft;

a stopper formed on the convex portion and being in contact with at least one of the vane portions for restricting a relative rotation between the housing member and the rotor member to an advanced angle side or a retarded angle side;

a lock mechanism for restricting the relative rotation between the housing member and the rotor member by a lock member formed on the housing member to be inserted into a receiving hole formed on the rotor member when a relative rotation phase between the housing member and the rotor member is positioned at a predetermined phase; and a fluid pressure circuit for controlling an operation oil to be supplied to or discharged from the advanced angle chamber, the retarded angle chamber, and the lock mechanism; wherein when the relative rotation between the housing member and the rotor member is restricted, the lock member is in contact with an inner peripheral face of the receiving hole on the advanced angle side and the retarded angle side between an opening portion and a bottom portion of the receiving hole.

2. A variable valve timing control device according claim 1, wherein when the relative rotation between the housing member and the rotor member is restricted, a contact width in a circumferential direction of a contact portion of the lock member, with which the inner peripheral face of the receiving hole on the advanced angle side and the retarded angle side is in contact, is larger than a bottom width in the circumferential direction of the bottom portion of the receiving hole.

3. A variable valve timing control device according to claim 2, wherein when the relative rotation between the housing member and the rotor member is restricted, a gap is formed between the stopper and the vane portion.

4. A variable valve timing control device according to claim 3, wherein the lock member includes a head portion facing the bottom portion of the receiving hole and having a trapezoidal shape in cross section formed by a convex taper portion extending in a radially inward direction of the housing member and a top portion including a contact portion with which the inner peripheral face of the receiving hole is in contact.

5. A variable valve timing control device according to claim 4, wherein the inner peripheral face of the receiving hole includes a concave taper portion having a trapezoidal shape in cross section and gradually expanding towards an opening portion of the receiving hole.

6. A variable valve timing control device according to claim 2, wherein an advanced angle side face provided in a retarded angle direction on the inner peripheral face of the receiving hole and a retarded angle side face provided in an advanced angle direction of the inner peripheral face of the receiving hole form a first predetermined tapered angle and a second predetermined tapered angle respectively relative to each line in parallel with a radial direction of the rotor member, and one of the first predetermined tapered angle and the second predetermined tapered angle is larger than the other one of the first predetermined tapered angle and the second predetermined tapered angle.

7. A variable valve timing control device according to claim 6, wherein one of the first predetermined tapered angle and the second predetermined tapered angle of the advanced angle side face or the retarded angle side face provided in an opposite direction to a direction in which the relative rotation between the housing member and the rotor member is permitted by the lock mechanism being released is larger than the other one of the first predetermined tapered angle and the second predetermined tapered angle.

8. A variable valve timing control device according to claim 7, wherein when the relative rotation between the housing member and the rotor member is restricted and the lock member is positioned within the receiving hole, one of the advanced angle side face and the retarded angle side face of the receiving hole is in contact with a facing side face of the lock member.

9. A variable valve timing control device according to claim 8, wherein one of the advanced angle side face and the retarded angle side face provided in a direction in which the relative rotation between the housing member and the rotor member is permitted by the lock mechanism being released is in contact with a facing side face of the lock member.

10. A variable valve timing control device according to claim 1, wherein when the relative rotation between the housing member and the rotor member is restricted, a gap is formed between the stopper and the vane portion.

11. A variable valve timing control device according to claim 10, wherein the lock member includes a head portion facing the bottom portion of the receiving hole and having a trapezoidal shape in cross section formed by a convex taper portion extending in a radially inward direction of the housing member and a top portion including a contact portion with which the inner peripheral face of the receiving hole is in contact.

12. A variable valve timing control device according to claim 11, wherein the inner peripheral face of the receiving hole includes a concave taper portion having a trapezoidal shape in cross section and gradually expanding towards the opening portion of the receiving hole.

13. A variable valve timing control device according to claim 12, wherein the contact portion of the head portion of the lock member and the concave taper portion of the inner peripheral face of the receiving hole are in contact with each other on the advanced angle side and the retarded angle side when the relative rotation between the housing member and the rotor member is restricted.

14. A variable valve timing control device according to claim 1, wherein an advanced angle side face provided in a retarded angle direction on the inner peripheral face of the receiving hole and a retarded angle side face provided in an advanced angle direction on the inner peripheral face of the receiving hole form a first predetermined tapered angle and a second predetermined tapered angle respectively relative to each line in parallel with a radial direction of the rotor member, and one of the first predetermined tapered angle and the second predetermined tapered angle is larger than the other one of the first predetermined tapered angle and the second predetermined tapered angle.

15. A variable valve timing control device according to claim 14, wherein one of the first predetermined tapered angle and the second predetermined tapered angle of the advanced angle side face or the retarded angle side face provided in an opposite direction to a direction in which the relative rotation between the housing member and the rotor member is permitted by the lock mechanism being released is larger than the other one of the first predetermined tapered angle and the second predetermined tapered angle.

16. A variable valve timing control device according to claim 15, wherein when the relative rotation between the housing member and the rotor member is restricted and the lock member is positioned within the receiving hole, one of the advanced angle side face and the retarded angle side face of the receiving hole is in contact with a facing side face of the lock member.

17. A variable valve timing control device according to claim 16, wherein one of the advanced angle side face and the retarded angle side face provided in a direction in which the relative rotation between the housing member and the rotor member is permitted by the lock mechanism being released is in contact with a facing side face of the lock member.

* * * * *